US010016773B2

(12) United States Patent
Tullney et al.

(10) Patent No.: US 10,016,773 B2
(45) **Date of Patent: *Jul. 10, 2018**

(54) TRIGGER SUPPORT FOR A LIQUID APPLICATOR

(71) Applicant: Wagner Spray Tech Corporation, Plymouth, MN (US)

(72) Inventors: Heiko Tullney, Hamburg (DE); Ross D. Rossner, St. Michael, MN (US); Joseph W. Kieffer, Chanhassen, MN (US); Douglas Paul Pozanc, Winona, MN (US); Brian Lee Fideler, Jordan, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 94 days.

This patent is subject to a terminal disclaimer.

(21) Appl. No.: 15/257,519

(22) Filed: Sep. 6, 2016

(65) Prior Publication Data

US 2016/0375453 A1 Dec. 29, 2016

Related U.S. Application Data

(63) Continuation-in-part of application No. 15/177,718, filed on Jun. 9, 2016, now Pat. No. 9,975,131.

(Continued)

(51) Int. Cl.
*B05B 1/26* (2006.01)
*B05B 12/00* (2018.01)

(Continued)

(52) U.S. Cl.
CPC ..... *B05B 12/002* (2013.01); *B05B 7/0815* (2013.01); *B05B 9/01* (2013.01)

(58) Field of Classification Search
CPC ..... B05B 12/002; B05B 9/01; B05B 7/0815

(Continued)

(56) References Cited

U.S. PATENT DOCUMENTS 4,083,497 A * 4/1978 Rosenberger ..... B05B 9/01 239/526
2006/0118661 A1 6/2006 Hartle et al.

(Continued)

FOREIGN PATENT DOCUMENTS

JP 2009-131813 A 6/2009
KR 20-0466824 Y1 5/2013

OTHER PUBLICATIONS

Amendment for U.S. Appl. No. 15/177,718 dated Oct. 17, 2017, 10 pages.

(Continued)

*Primary Examiner* — Steven J Ganey
(74) *Attorney, Agent, or Firm* — Christopher J. Volkmann; Kelly, Holt & Christenson, PLLC

(57) ABSTRACT

A fluid applicator configured to reduce user fatigue is presented. The applicator comprises an inlet and an outlet fluidically coupled by a fluid path. The applicator also comprises a trigger. The trigger is configured to, when actuated, move between a closed position and an open position. The open position comprises a fluid flowing from the inlet, to the outlet, along the fluid path. The applicator also comprises a trigger support configured to reduce a pressure required to maintain the trigger in an open position. The trigger support is configured to reduce the pressure required as the trigger actuates between the closed position and the open position.

20 Claims, 18 Drawing Sheets

Related U.S. Application Data

(60) Provisional application No. 62/181,574, filed on Jun. 18, 2015.

(51) Int. Cl.
*B05B 9/01* (2006.01)
*B05B 7/08* (2006.01)

(58) Field of Classification Search
USPC ..... 239/290, 296, 525, 526
See application file for complete search history.

(56) References Cited

U.S. PATENT DOCUMENTS

| | | | | |
|---|---|---|---|---|
| 2007/0228190 | A1 | 10/2007 | Tanner | |
| 2008/0017734 | A1* | 1/2008 | Micheli | B05B 1/00 239/296 |
| 2011/0114757 | A1 | 5/2011 | Munn et al. | |
| 2014/0346257 | A1* | 11/2014 | Reetz, III | B05B 12/002 239/526 |
| 2016/0368010 | A1 | 12/2016 | Tullney et al. | |

OTHER PUBLICATIONS

Non-Final Office Action for U.S. Appl. No. 15/177,718 dated Sep. 25, 2017, 8 pages.
International Search Report and Written Opinion for International Patent Application No. PCT/US2016/037312, dated Sep. 22, 2016, date of filing: Jun. 14, 2016, 14 pages.
International Preliminary Report on Patentability for International Application No. PCT/US2016/037312, dated Dec. 28, 2017, 10 pages.

* cited by examiner

TRIGGER SUPPORT FOR A LIQUID APPLICATOR

CROSS-REFERENCE TO RELATED APPLICATIONS

The present application is a continuation-in-part application of U.S. patent application Ser. No. 15/177,718, filed Jun. 9, 2016, which is based on and claims the benefit of U.S. Provisional Patent Application Ser. No. 62/181,574 filed Jun. 18, 2015, the content of which is hereby incorporated by reference in its entirety.

BACKGROUND

Many liquid applicators, for example paint applicators, include a spray gun with a trigger. Triggers on paint applicators are often pressure actuated, for example, a user's hand or fingers can apply force to a trigger and, as a result of the applied force, paint, or another exemplary liquid, flows from an outlet of the liquid applicator. However, when a user releases pressure on the trigger, the outgoing flow ceases. For at least some paint applicators, the applied pressure corresponds to a volumetric flow rate of liquid exiting the applicator.

A liquid dispensing system may be used by an operator in order to deliver a solution, for example, from a storage area to an application area and then applied to a surface. Liquid dispensing systems often include an applicator to apply the delivered solution to a surface. In using a paint applicator, for example, an operator may apply pressure to a trigger in order to actuate a pressurized flow of paint through the applicator. However, the position of the user's hand on the applicator, over a painting operation, may create tension, or irritation for the user during a paint application process.

SUMMARY

A fluid applicator configured to reduce user fatigue is presented. The applicator comprises an inlet and an outlet fluidically coupled by a fluid path. The applicator also comprises a trigger. The trigger is configured to, when actuated, move between a closed position and an open position. The open position comprises a fluid flowing from the inlet, to the outlet, along the fluid path. The applicator also comprises a trigger support configured to reduce a pressure required to maintain the trigger in an open position. The trigger support is configured to reduce the pressure required as the trigger actuates between the closed position and the open position.

DETAILED DESCRIPTION OF ILLUSTRATIVE EMBODIMENTS

Many paint applicators require a constant application of pressure to actuate a trigger mechanism, allowing paint to flow through and be sprayed by the applicator. Additionally, a higher amount of pressure is required to keep a spring-loaded trigger fully actuated, as opposed to a partially actuated position. For many conventional paint spray guns, this design causes user fatigue over the length of the paint spraying operation. A spray gun is desired that has a reduced spring force in a fully actuated position, in order to reduce user fatigue experienced over design. Some embodiments provided herein include a mechanical detent configured to relieve the force required by a user to maintain an actuated position, reducing user fatigue.

Aspects of the present disclosure relate to fluid applicators, for example applicators configured to dispense paint, coatings, textured material, plural components, etc. While the present disclosure is not necessarily limited to such applications, various aspects of the disclosure may be appreciated through a discussion of various examples, for example paint, in order to provide context.

Fluid applicators are commonly actuated by a trigger mechanism, such that when a user actuates a trigger, for example by applying pressure, a fluid channel opens within the applicator allowing fluid flow through the applicator and be dispersed. For example, a user of a paint spray gun may pull a trigger back with one or more fingers, and hold the trigger in order to allow for paint to continuously flow through the applicator and be dispersed onto a desired surface. In some cases, actuating a trigger requires significant pressure applied by a user's hand and/or fingers, the application of which may need to be consistently and constantly applied to keep fluid flowing through the applicator. This cause fatigue in a user's hands and arms. It is desired for a trigger to have a support mechanism such that, once actuated, reduces the required pressure, or tension, needed to maintain fluid flow, which may reduce fatigue experienced during an operation.

Triggers are often configured to maintain a non-actuated position while not in use, for example to reduce the risk of accidental fluid discharge. Some triggers are spring-loaded. One mechanism for actuating a spring-loaded trigger requires rotating the trigger, causing a spring to compress as the trigger is actuated. As a result, as a trigger is actuated, the required force increases, requiring a user to apply the greatest amount of force while the trigger is fully actuated. It is desired that, in this fully actuated position, some or all of the required force is relieved. At least some embodiments described herein provide a mechanical detent configured to reduce or relieve some or all of the force required to maintain a trigger in a fully actuated position.

Figure 1A:
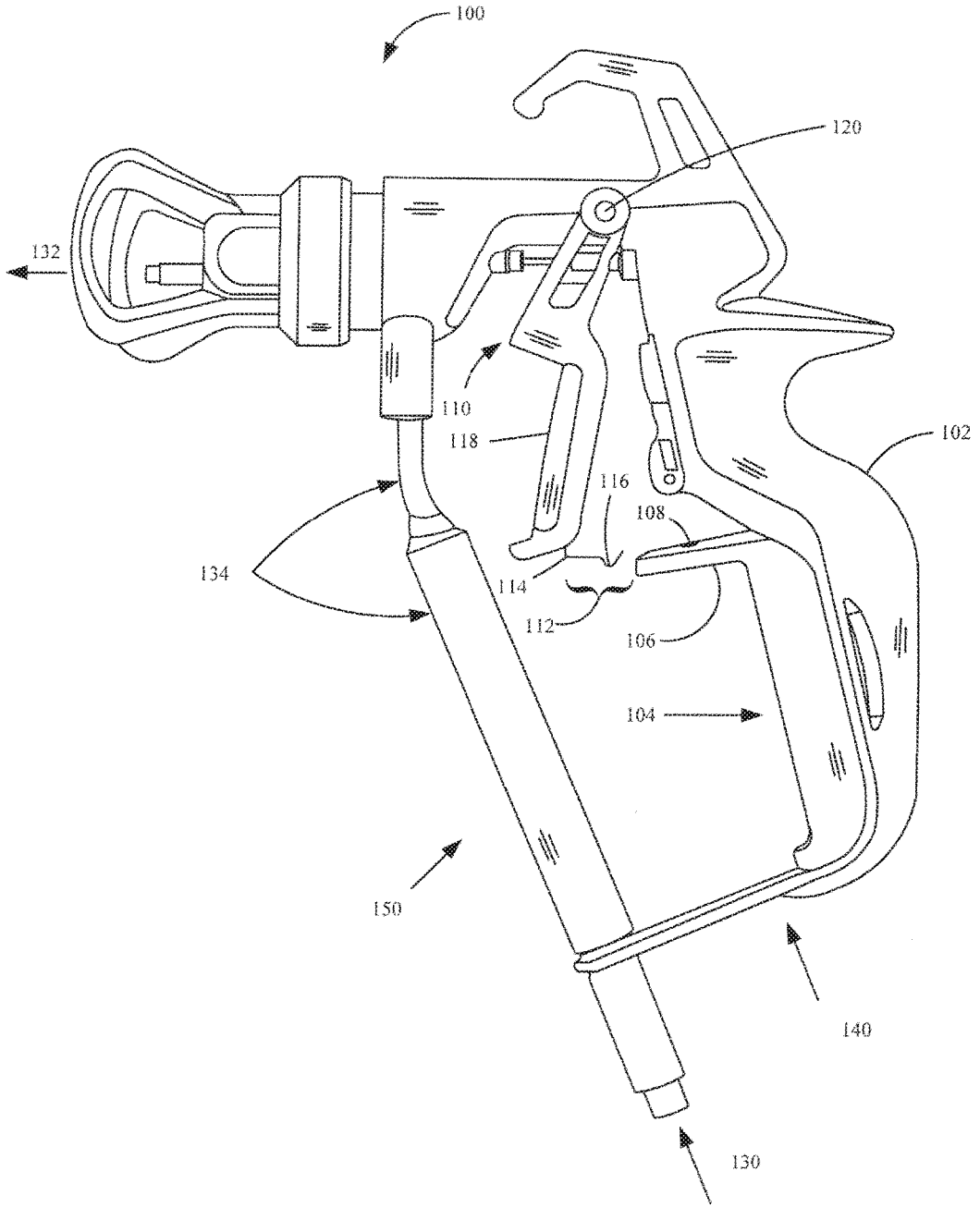
FIGS. 1A-1C illustrate a plurality of positions of a fluid applicator in accordance with one embodiment of the present invention.
Figure 1B:
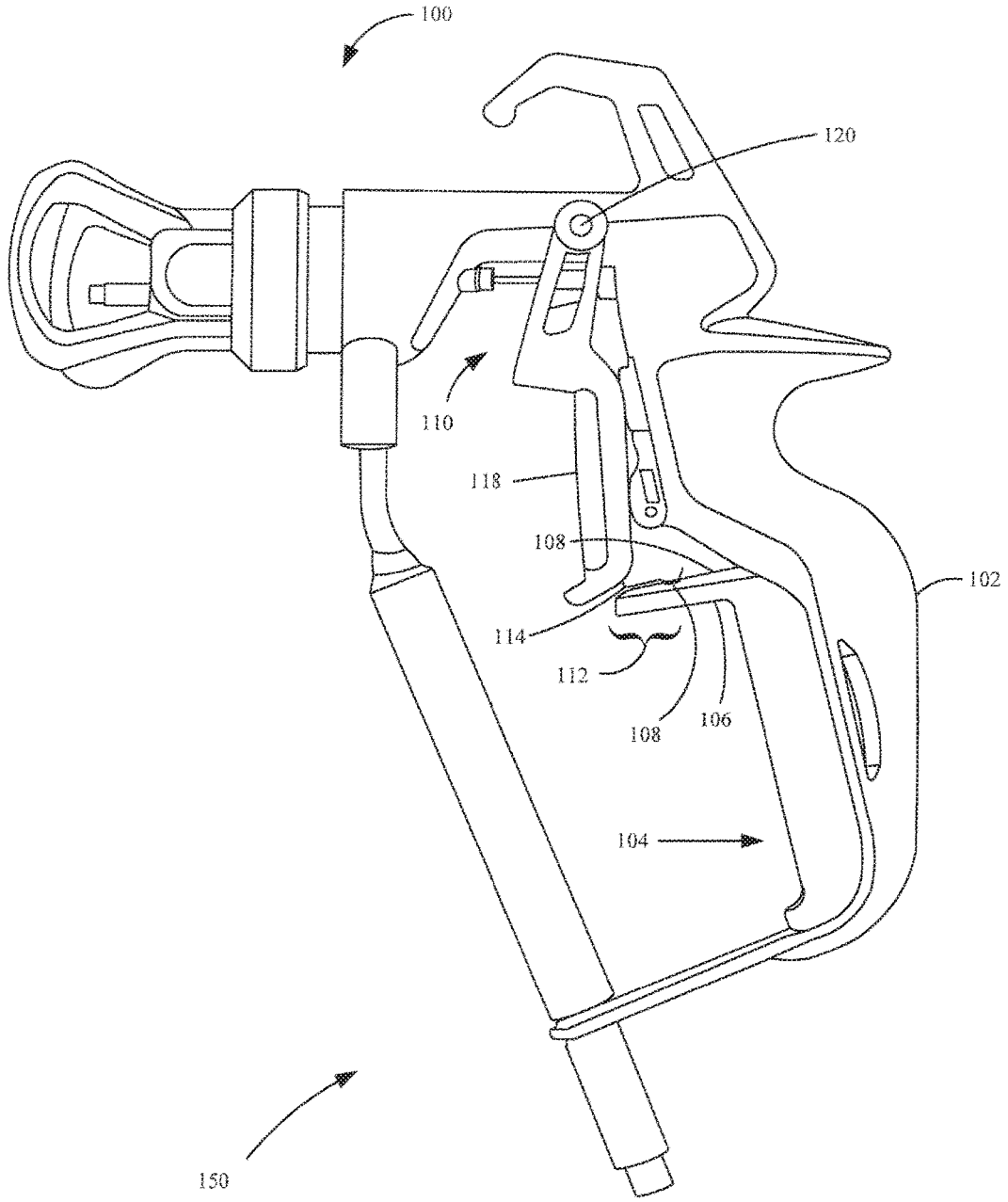
Figure 1C:
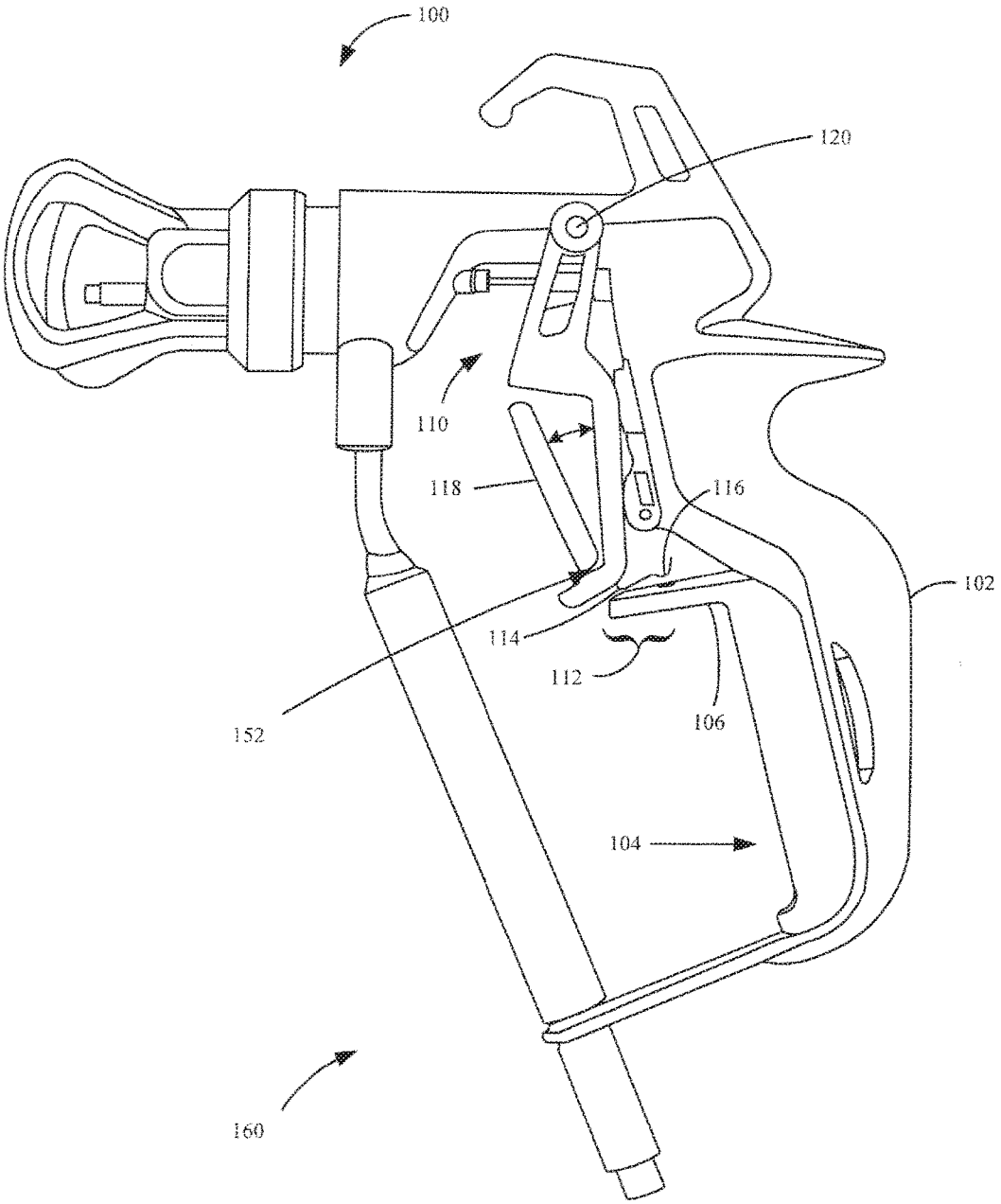

FIGS. 1A-1C illustrate a plurality of positions of a fluid applicator in accordance with one embodiment of the present invention. Fluid applicator 100 comprises a handle 102 coupled, in one embodiment, to a grip 104 configured to support a user's hand during a fluid application. The user may actuate applicator 100 by applying pressure to a trigger 110, for example by resting one or more fingers on finger rest 118 and pulling the trigger back towards a trigger stop located behind trigger 110, and maintaining a level of tension on trigger 110. In one embodiment, as force is applied to the trigger 110, the trigger pivots about a trigger pivot point 120 such that fluid coming into the applicator 100 at inlet 130 flows along fluid path 134 and exits applicator 100 at outlet 132.

In one embodiment, once a user has actuated trigger 110 past a certain point, for example such that it nears or reaches a trigger stop point, trigger detent mechanism 112 actuates. In one embodiment, trigger detent mechanism 112 comprises one or more trigger fastening features 114. Actuating trigger detent mechanism may comprise, in one embodiment, trigger fastening feature(s) 114 coupling to a trigger coupling point 106 and engaging with a trigger receiver 108. In one embodiment, for example that shown in FIG. 1A, trigger fastener features 114 comprise a ridge and a hook configured to couple to an aperture or indentation 108 at trigger coupling point 106.

In one embodiment, when trigger detent mechanism 112 is actuated, it holds trigger 110 in place such that a user could remove their finger from the trigger and the fluid channel 134 would remain open. In another embodiment, trigger detent mechanism 112 is only configured to reduce a pressure required to maintain the trigger in a trigger detent position, such that at least some pressure must be applied to hold trigger 110 in place. For example, when a user releases trigger detent mechanism 112, in one embodiment, trigger 110 also releases, and returns to a closed position 140, for example that shown in FIG. 1A. In one embodiment, release of trigger detent mechanism 112 and trigger 110 happen substantially simultaneously. In another embodiment, release of one of trigger 110 and detent mechanism 112 is contingent upon release of the other.

FIG. 1B illustrates a fluid applicator 100 in an open position 150. Open position 150, in one embodiment, comprises a fluid path, for example fluid path 134, fluidically coupling an inlet, for example inlet 130 to an outlet, for example outlet 132. In open position 150, trigger detent mechanism 112 may be actuatable. In one embodiment, trigger detent mechanism 112 actuates as trigger approaches open position 150. In one embodiment, trigger detent mechanism 112 actuates as trigger enters open position 150. For example, as shown in FIG. 1B, trigger fastening feature 114 is coupled to a trigger coupling point 106 such that it is received by a trigger receiver 108.

In one embodiment, applicator 100 also comprises a trigger rest pivot point 152, configured to allow a trigger rest to move to a trigger rest adjusted position 160, for example that shown in FIG. 1C. In one embodiment, as trigger rest moves between the positions shown in FIGS. 1B and 1C, trigger detent mechanism 112 moves into, or out of, coupling point 106. In one embodiment, if a user removes pressure from finger rest 118, finger rest 118 rotates about pivot point 152, such that trigger detent mechanism 112 disengages from coupling point 106.

Figure 2A:
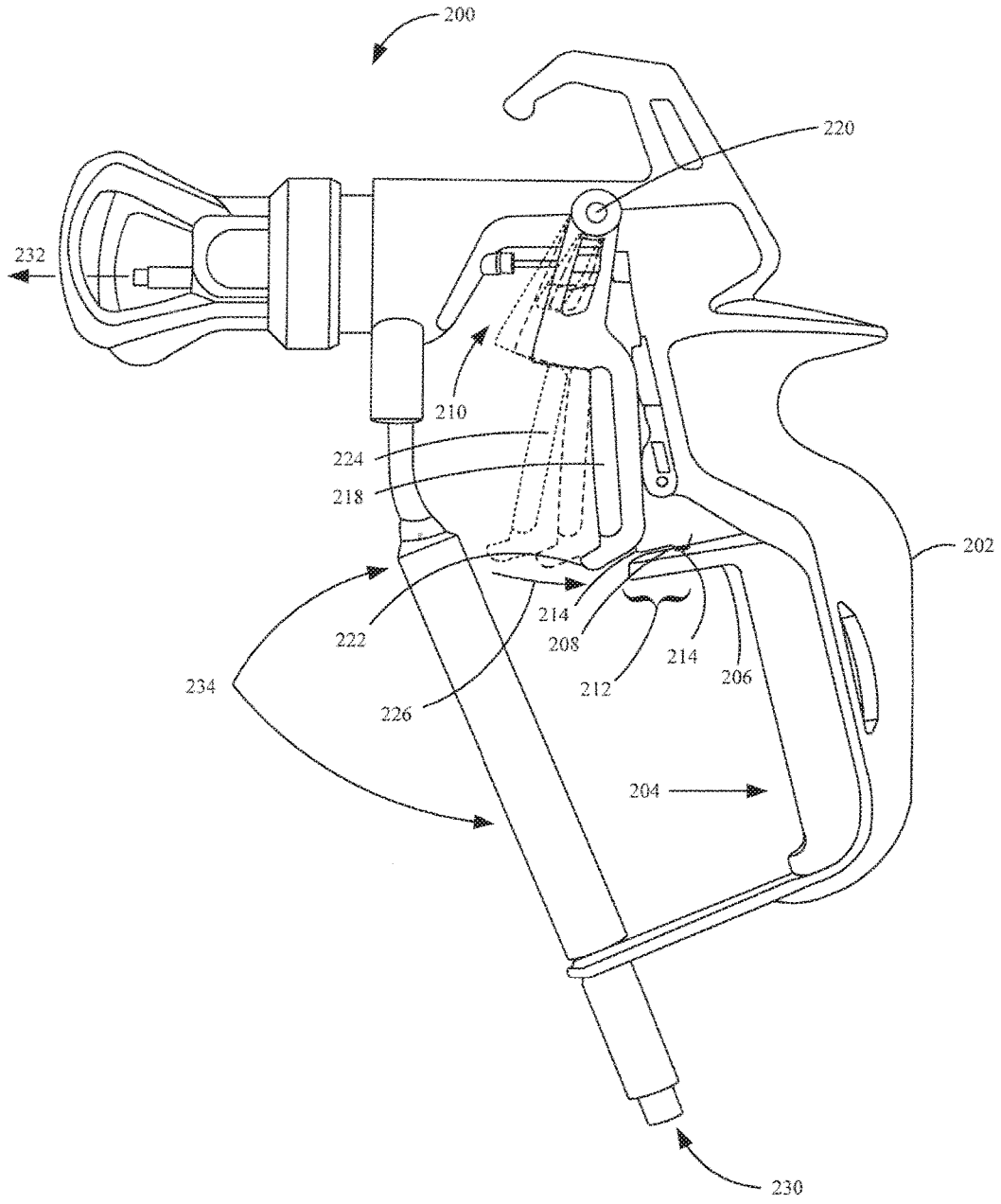
FIGS. 2A and 2B illustrate a series of transitional positions of a fluid applicator in accordance with one embodiment of the present invention.
Figure 2B:
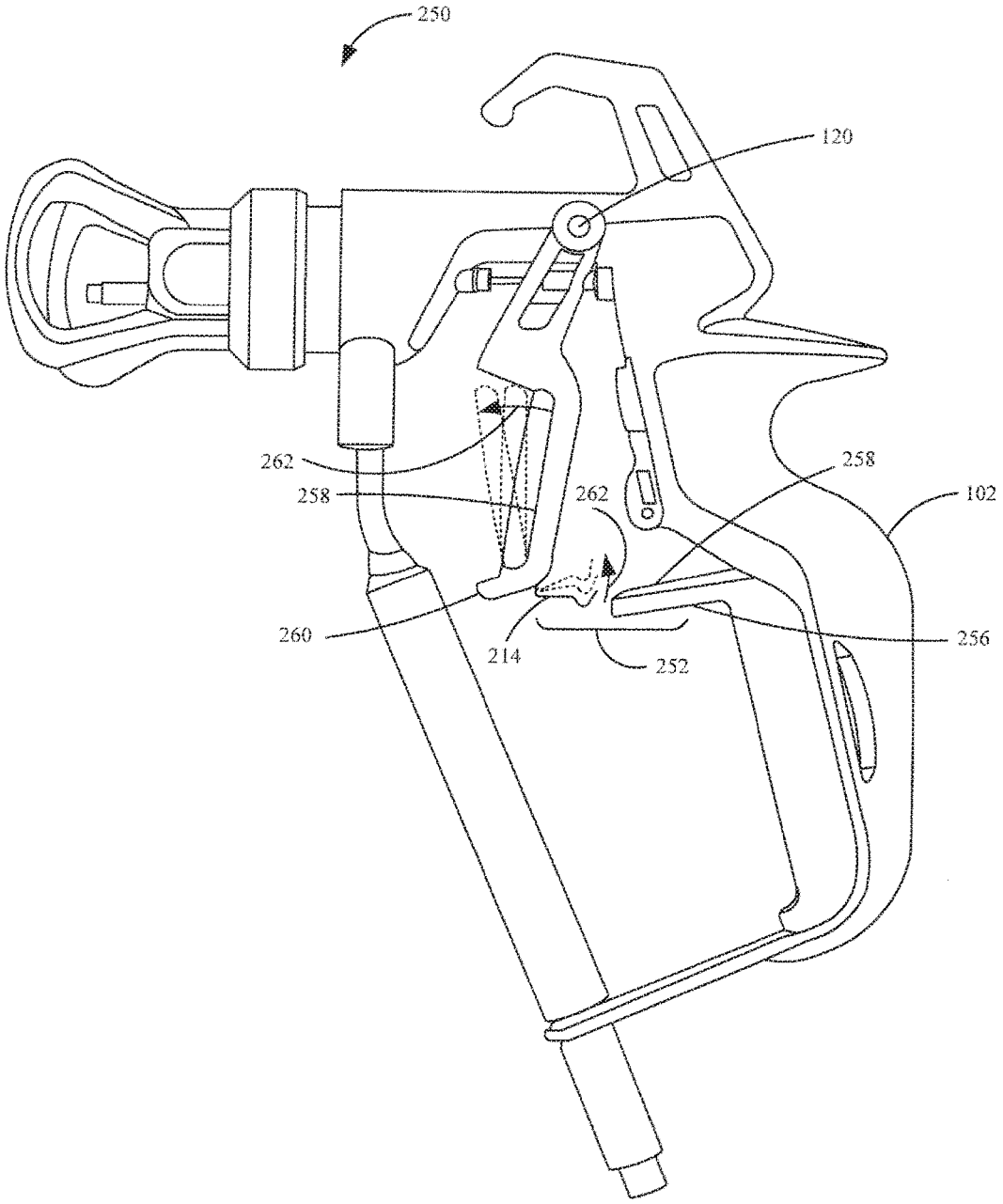

FIGS. 2A and 2B illustrate a series of transitional positions of a fluid applicator in accordance with one embodiment of the present invention. FIG. 2A illustrates an applicator 200, with a handle 202, illustratively coupled to a grip 204. Applicator 200 also comprises a trigger 210 configured to removably couple to a trigger coupling point 206 such that it supports a user of applicator 200 by alleviating a required force to maintain trigger 210 in a spraying position. In one embodiment, trigger coupling point 206 comprises a trigger receiving feature 208, for example an indentation or a hole configured to couple to a trigger detent mechanism 212 located on, or otherwise associated with, trigger 210.

In one embodiment, trigger detent mechanism 212 comprises one or more trigger fastening features 214. Trigger fastening features 214 may comprise physical structures, in one embodiment, for example a ridge and/or a hook configured to extend from trigger 210, and removably couple to trigger receiving mechanism 208. Features 214 may also comprise other support mechanisms, for example magnets. In one embodiment, as a user applies pressure to a trigger rest 218, trigger 210 moves along the direction indicated by arrow 226, such that trigger detent mechanism 212 nears and engages with trigger coupling point 206. In one embodiment, this comprises trigger 210 moving between a detent position 222 and a closed position 224. Detent position 222 may comprise a trigger 210 fully actuated such that fluid can flow through applicator 200, for example into inlet 230, along fluid path 234, and exiting through outlet 232. In one embodiment, as trigger 210 is actuated, for example along arrow 226, the trigger pivots about a trigger pivot point 220.

FIG. 2B illustrates an applicator 252 with a trigger detent mechanism 252. The trigger detent mechanism 252 may, in one embodiment, be similar to trigger detent mechanism 212 of FIG. 2A. However, as shown in FIG. 2B, in one embodiment, trigger detent mechanism 252 comprises a shorter ridge and a more pronounced hook. The more pronounced hook of trigger detent mechanism 252 may allow for better coupling to trigger coupling point 256. In one embodiment, this may allow for a user to apply a smaller force to the trigger in order to maintain applicator 252 in a fully actuated position. In one embodiment, trigger rest 258 may comprise a trigger rest pivot point 260 which may allow for movement of trigger rest 258 through a range of movements indicated by trigger rest movement arrow 262. As trigger rest 258 moves in the direction indicated by arrow 262, fastening features 214 lift, and decouple from, coupling point 256, allowing the applicator to return to a closed position. In one embodiment, trigger detent mechanism 252 is sufficient to maintain applicator 252 in a detent position, such that only a force required to retain trigger rest 258 in a position adjacent to the trigger. When such force is removed, trigger rest 258 moves away from the trigger, in the direction indicated by arrow 262, causing a decoupling of features 214 from coupling point 256.

Figure 3A:
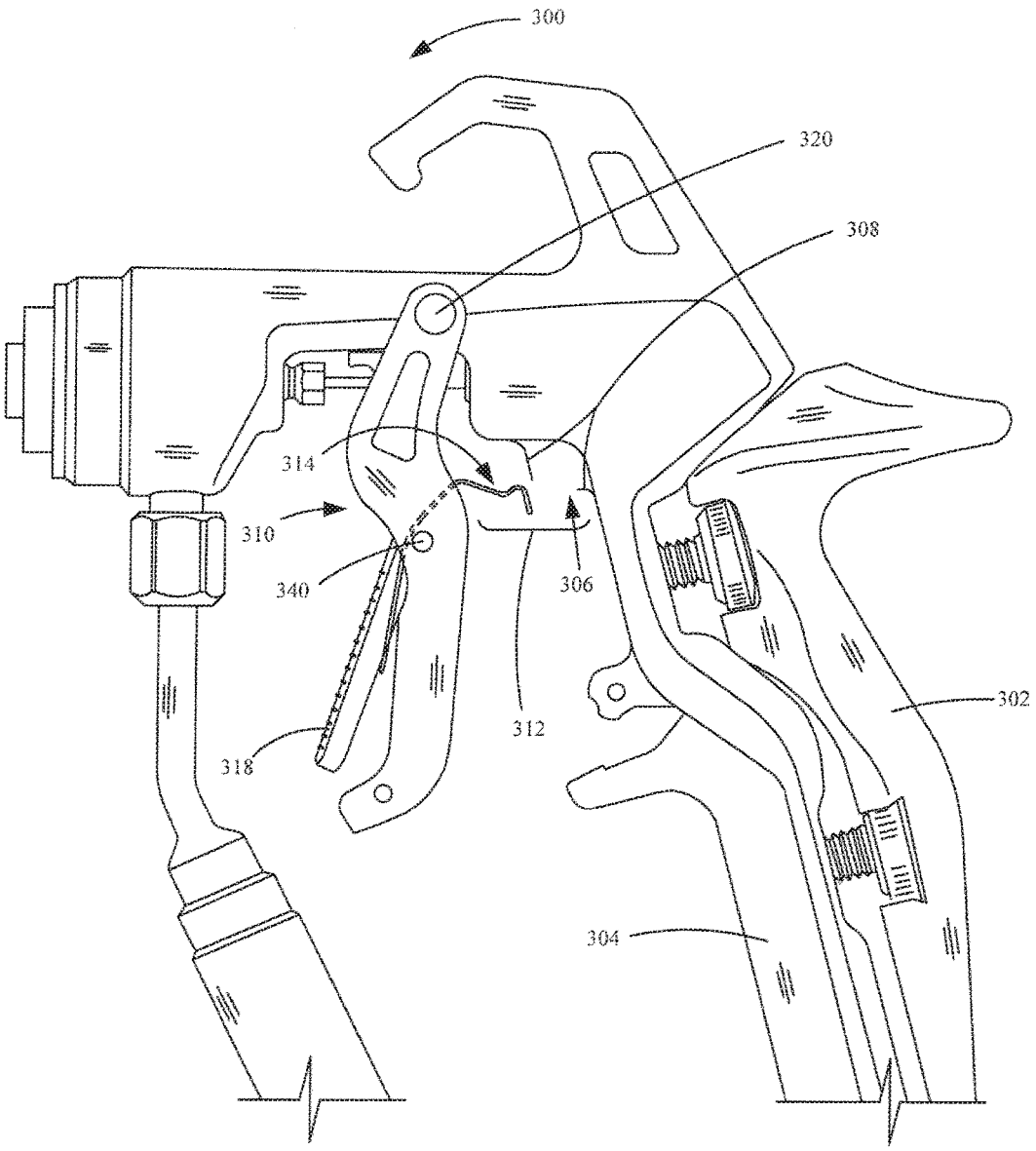
FIGS. 3A and 3B illustrate coupling positions of a trigger detent mechanism in accordance with one embodiment of the present invention.
Figure 3B:
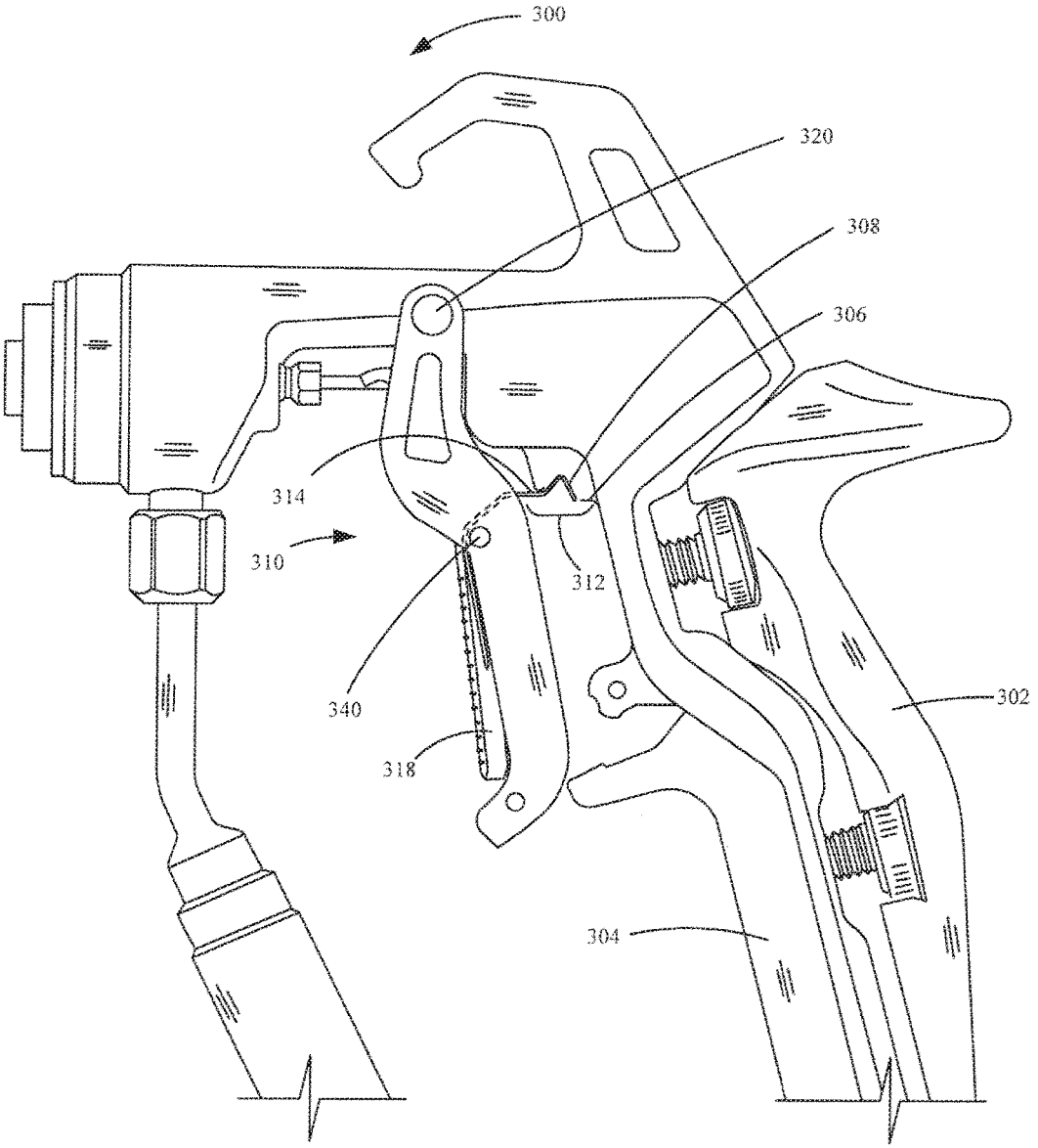

FIGS. 3A and 3B illustrate coupling positions of a trigger detent mechanism in accordance with one embodiment of the present invention. FIGS. 3A and 3B illustrate a trigger 310 of an applicator 300, for example a paint spray gun. In one embodiment, applicator 300 comprises a handle 302 coupled to a grip 304. Trigger 310, in one embodiment, comprises a trigger detent mechanism 312 with one or more fastening features 314. In one embodiment, applicator 300 may comprise one or more trigger coupling features 308 along a trigger coupling point 306. In one embodiment, multiple trigger coupling features 308 may better maintain trigger 310 in a detent position, with a reduced pressure required by a user compared to conventional applicators. This may reduce the amount of fatigue experienced by a user during a job, and may allow a user to continue using an applicator for a longer period of time.

In one embodiment, trigger 310 also comprises a trigger rest 318 configured to receive one or more fingers of a user's hand. Trigger rest 318 may also comprise a pivot point 340.

Movement of trigger rest 318, about pivot point 340, may allow for trigger detent mechanism 312 to approach and engage with trigger coupling point 306, for example by engaging with fastening features 308. In one embodiment, trigger 310 comprises a trigger pivot point 320 that, when actuated, may allow for applicator 300 to disperse fluid through a fluid outlet 332.

FIG. 3B illustrates applicator 300 with trigger 310 in a detent position. In one embodiment, the detent position comprises the trigger detent mechanism 312 engaging a trigger coupling point 306, such that trigger fastening features 314 couple trigger coupling features 308.

Figure 4B:
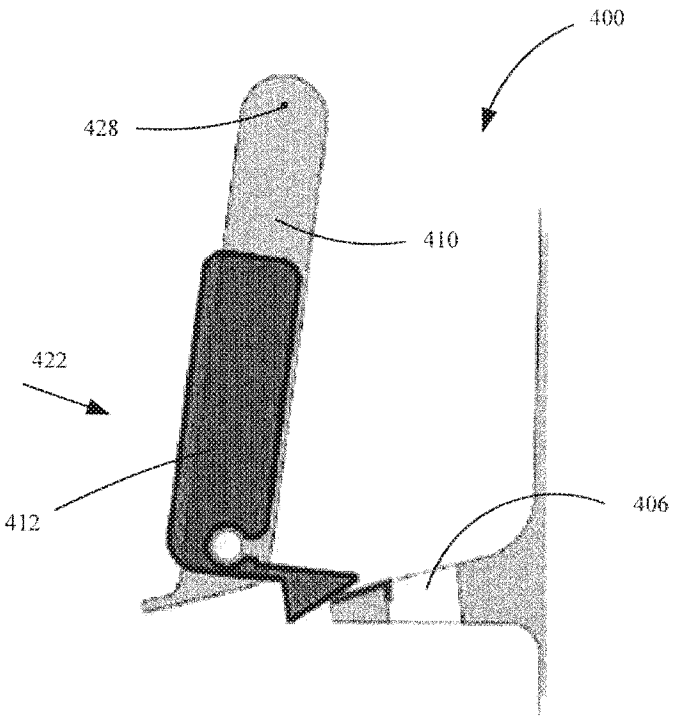
FIGS. 4A-4E illustrate a trigger detent mechanism transitioning between closed and detent positions in accordance with one embodiment of the present invention.
Figure 4A:
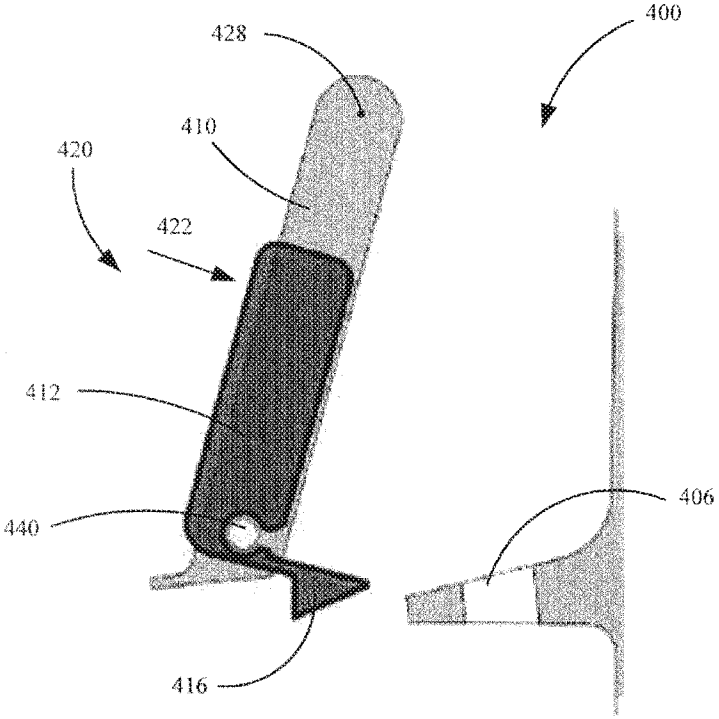

FIGS. 4A-4E illustrate a trigger detent mechanism transitioning between closed and detent positions in accordance with one embodiment of the present invention. In one embodiment, an applicator 400 comprises a trigger 410 with a trigger detent mechanism 412. Trigger detent mechanism 412 may, in one embodiment, couple to, or replace, a trigger rest, such that the trigger detent mechanism 412 directly receives and transfers applied pressure from a user (e.g. from a hand and/or fingers) to trigger 410. Trigger detent mechanism 412 may be configured, in one embodiment, to couple to a trigger coupling point 406 on an applicator 400. In one embodiment, trigger rest 406 is located on a handle of an applicator 400 (not shown). Trigger detent mechanism 412, in one embodiment, comprises one or more fastening features 416. In one embodiment, as illustrated in FIG. 4A, for example, fastening feature 416 comprises a spear-shaped protrusion configured to hook into trigger coupling point 406, for example as shown more clearly in FIG. 4D, described below.

FIG. 4A illustrates, for example, trigger 410 in a closed position 420. In one embodiment, closed position 420 comprises trigger 410 in a relaxed position, with substantially no pressure applied by a user. In one embodiment, as a user applies pressure to a trigger 410 the trigger moves about a pivot point 428. In one embodiment, as a trigger moves about pivot 428, fastening feature 416 approaches trigger coupling point 406, for example as shown in the transition between FIGS. 4A to 4B and between FIGS. 4B to 4C.

Figure 4E:
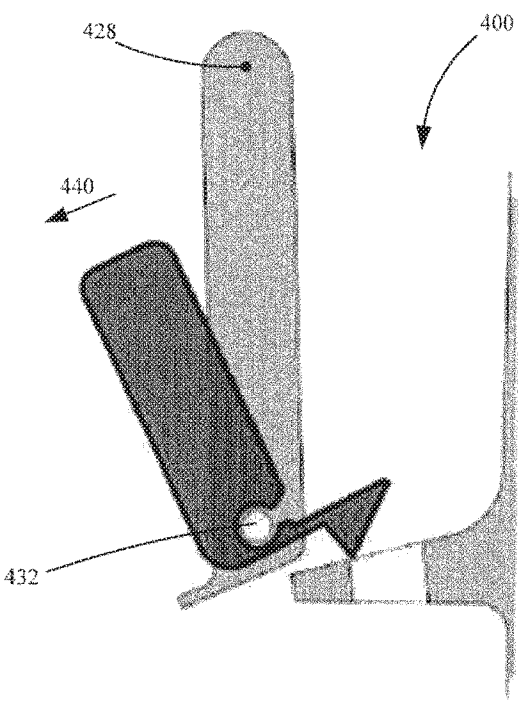
Figure 4D:
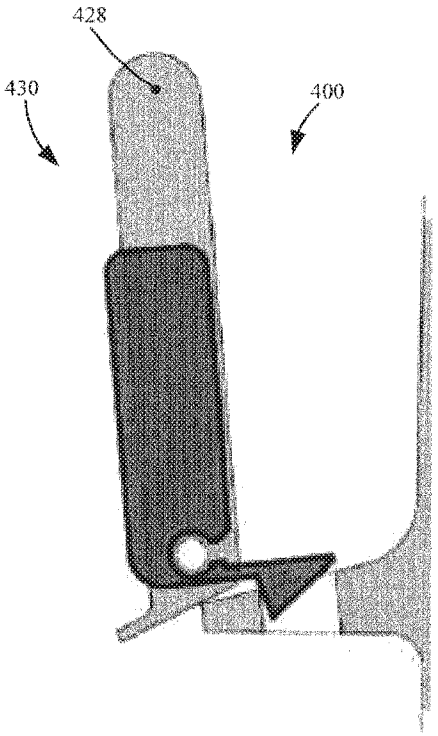
Figure 4C:
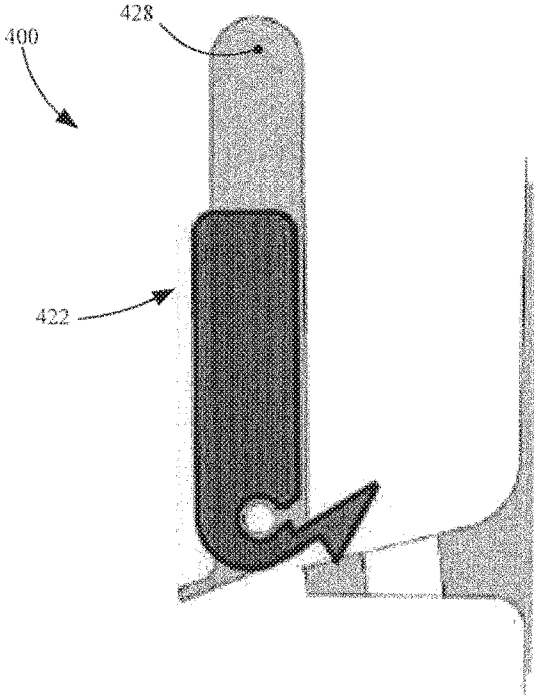

In one embodiment, for example that shown in FIG. 4D, trigger 410 has moved into a detent position 430. Detent position 430 may comprise a fastening feature 416 coupled to a trigger coupling point 406. In one embodiment, detent position 430 comprises the trigger 410 in a position such that trigger 410 maintains an open configuration with substantially no applied force. However, in another embodiment, detent position 430 comprises the trigger in a low spring force position, such that a user has to apply some pressure to maintain trigger 410 in detent position, less pressure than required by a conventional spray gun. For example, the force required to maintain a trigger 410 in detent position 430 may be substantially less than that required to actuate trigger 410 about pivot point 428, along direction 422, to move trigger 110 into detent position 430.

Trigger detent mechanism 412 may pivot about a detent pivot point 432, for example as shown in FIG. 4E. In one embodiment, as trigger detent mechanism 412 rotates about pivot point 432, and fastening feature 416 rises up and away from trigger coupling point 406. In one embodiment, trigger detent mechanism 412 automatically releases once pressure is no longer applied by a user. This may be advantageous, as it allows for flow of fluid from an applicator to stop substantially immediately after pressure is released from a trigger, such that dripping and accidental spraying do not occur.

Figure 5A:
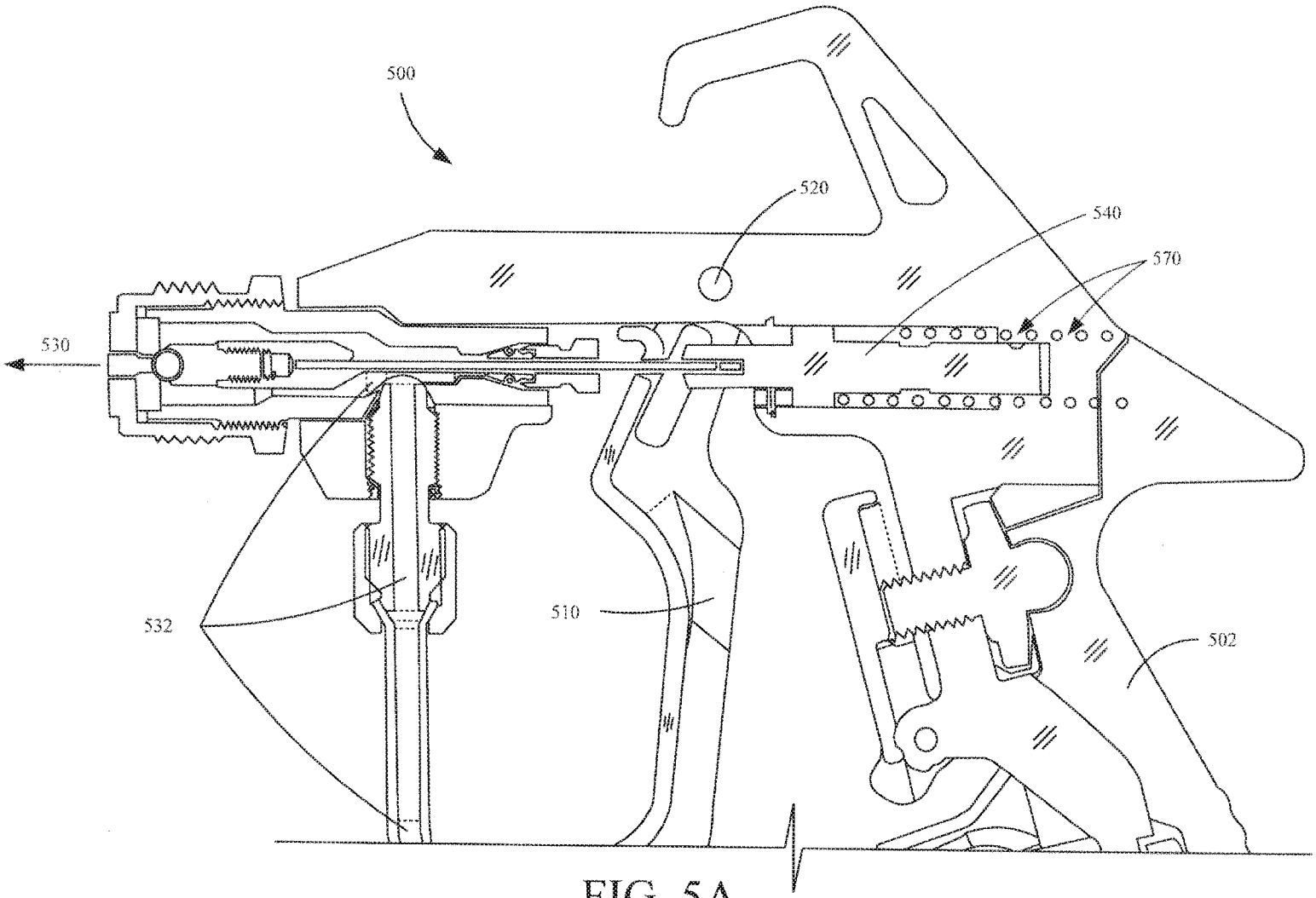
FIGS. 5A-5E illustrate cutaway views of an applicator with a trigger detent mechanism in accordance with one embodiment of the present invention.

FIGS. 5A-5E illustrate cutaway views of an applicator with a trigger detent mechanism in accordance with one embodiment of the present invention. FIG. 5A illustrates a cutaway view of an applicator 500, illustrating an interior through a substantially lengthwise cut from inlet to handle. In one embodiment, applicator 500 comprises a handle 502, a trigger 510 that, when actuated, rotates about a trigger pivot point 520 such that a fluid path 532 is open through the applicator. In one embodiment, a trigger detent mechanism is located along a shaft internal to the applicator, for example shaft 540, shown in FIG. 5A. One or more detent mechanisms may be located inside applicator 500 such that, as shaft 540 actuates (e.g. as trigger 510 actuates), detent mechanisms contact, and couple to, receiving point 570. For example, in one embodiment either of the frame or shaft 540 comprises threading such that, as shaft 540 actuates within applicator 500, it couples at receiving point 570. In another embodiment, receiving point 570 is located within a frame of applicator 500, and détente mechanisms are located along shaft 540, such that receiving point 570 remains stationary while trigger 510 is actuated, and detent mechanisms move into place. In one embodiment, as détente mechanisms and receiving points 570 couple, some of the pressure required to maintain an actuated position of the trigger is relieved.

Figure 5B:
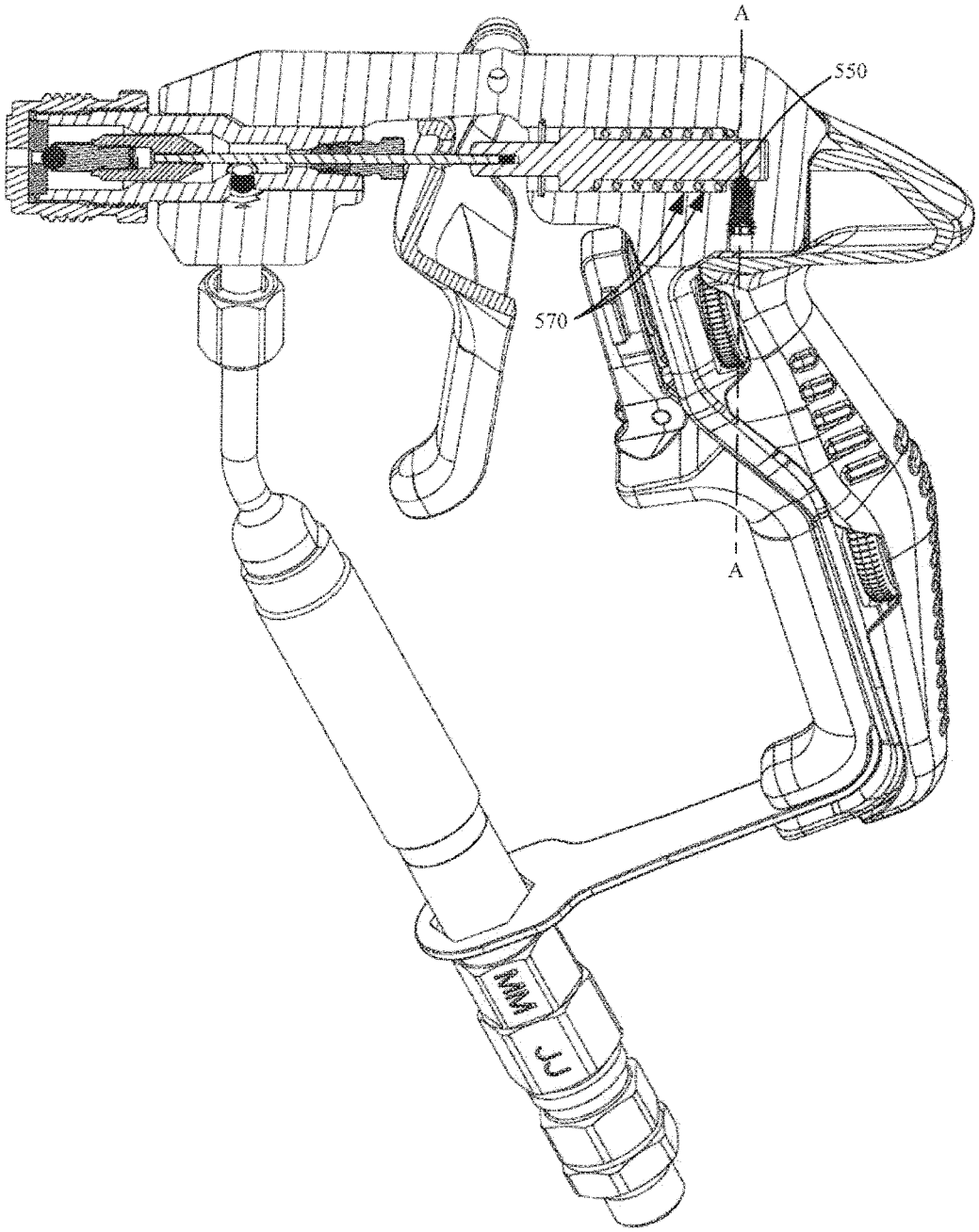

FIG. 5A illustrates one embodiment with exemplary receiving points 570. FIG. 5B illustrates one embodiment comprising a single detent mechanism 550 configured to couple to one of receiving points 570. However, in another embodiment, detent mechanism 550 is located on shaft 540 and is configured to couple to a receiving point 570 within applicator 500. In another embodiment, multiple detent mechanisms 550 and receiving points 570 are located along shaft 570 and/or the inside of applicator 500.

Figure 5C:
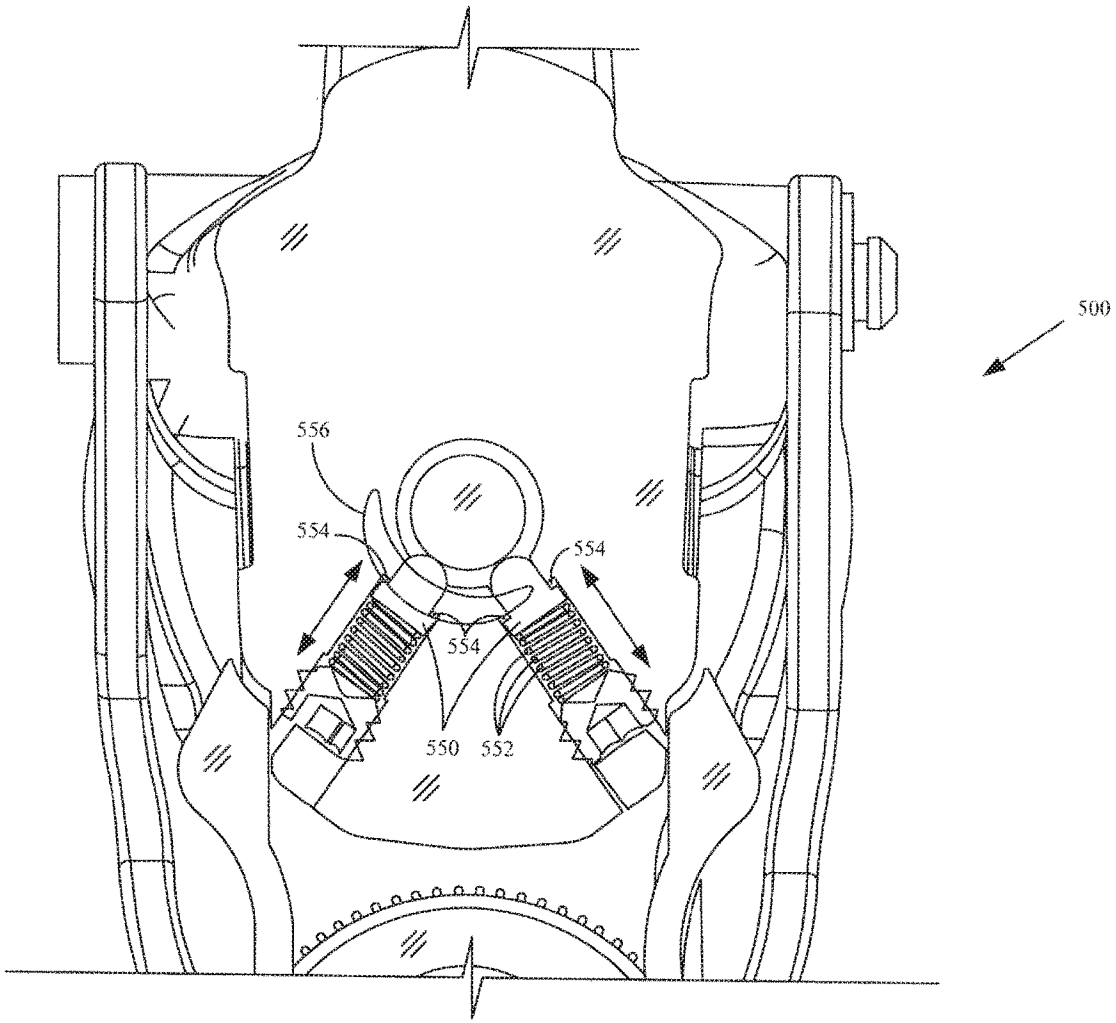

FIG. 5C illustrates a cutaway view of an applicator 500, taken substantially along line A-A, shown in FIG. 5A. In one embodiment, applicator 500 comprises one or more detent mechanisms 550 configured to support a trigger in an actuated position. In one embodiment, as a trigger is actuated, detent mechanism 550 may approach and couple to a detent receiving position 556 located within a frame of applicator 500. In one embodiment, detent mechanisms 550 comprise one or more threads 552 configured to be rotationally engaged and received by corresponding threads along an interior of applicator 500.

In one embodiment, detent mechanisms 550 are configured to interact with detent receiving positions 556, such that fastening features 554 substantially engage with, and couple to, detent receiving positions 556. In one embodiment, actuation of the trigger comprises detent mechanisms 550 engaging with detent receiving position 556 such that no additional force is required to retain the trigger in an actuated position. In another embodiment, detent mechanisms 550 engage with detent receiving position 556 such that a user no longer needs to apply actuation pressure to maintain the trigger in an actuated position. Instead, a user applies a lower force, compared to conventional spray guns, to maintain an actuated trigger position, as detent mechanisms 550, when coupled to receiving position 556, relieve some of the force required.

FIG. 5C illustrates two detent mechanisms 550 configured to be received by two receiving positions 556 located along a shaft 540. However, embodiments herein are not limited to two detent mechanisms 550. In one embodiment, three detent mechanisms 550 are configured to be received by receiving positions 556. In another embodiment, more than three detent mechanisms 550 are configured to be received by receiving positions 556.

In one embodiment, detent mechanisms 550 are located substantially within a plane comprising the A-A line indicated in FIG. 5B. In another embodiment, detent mechanisms 550 are staggered along a length of shaft 570. In one embodiment, detent mechanisms 550 are configured such that they are located on substantially opposing sides of each other across shaft 570, for example such that they are on left and right sides of shaft 570, or on a top and bottom of shaft 570. In another embodiment, detent mechanisms 550 are arranged such that they are angled with respect to each other. For example, a configuration of three detent mechanisms 550 may be located substantially at 120° angles with respect to each other.

Additionally, while FIG. 5C illustrates stationary detent mechanisms 550 configured to be received by receiving positions 556 located on a mobile shaft 570, it is also envisioned that other embodiments are possible. For example, stationary receiving positions 556 located within an applicator housing, and mobile détente mechanisms 550 located on mobile shaft 570.

Figure 5D:
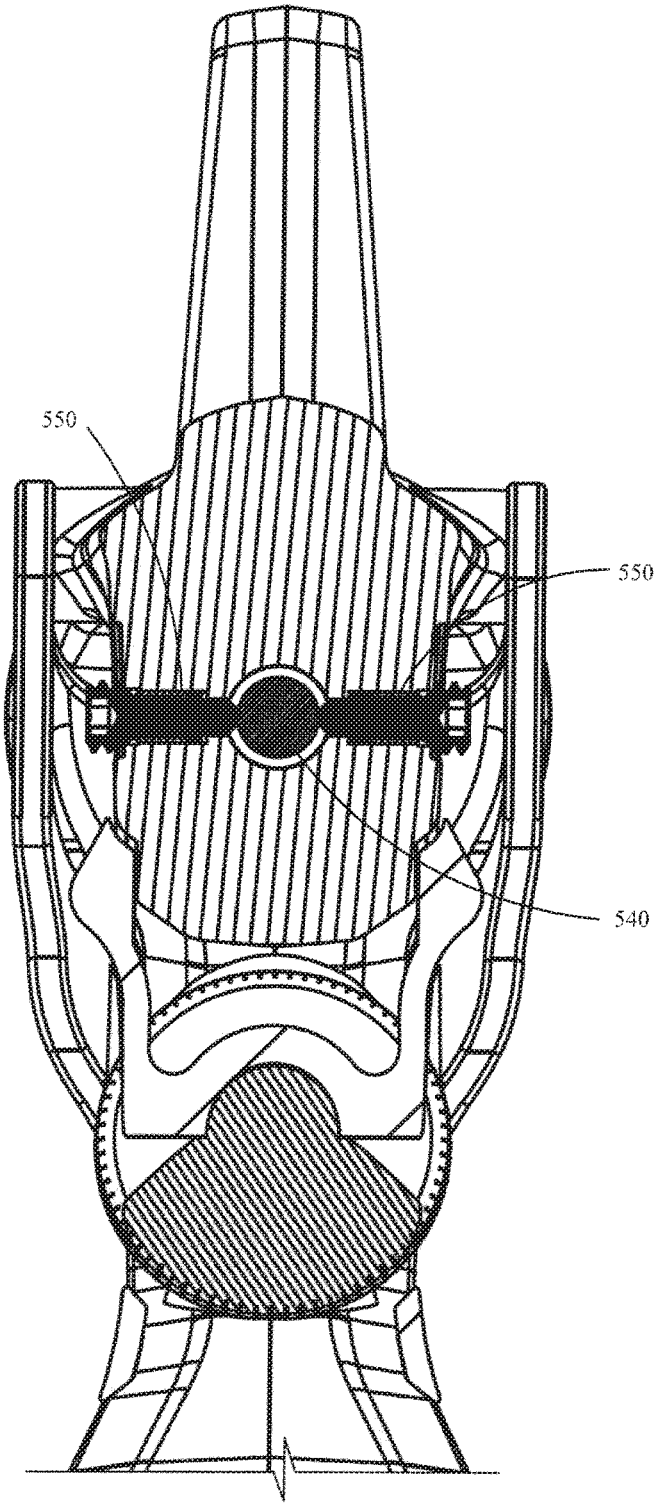

FIG. 5D illustrates two other exemplary configurations of detent mechanisms 550, in accordance with other embodiments of the present invention. FIG. 5D illustrates a configuration of two detent mechanisms 550 on opposing sides of a shaft 540. However, a pair of detent mechanisms 550, in another embodiment, may be in another configuration, for example arranged in an acute angular position with respect to each other and shaft 540. In another embodiment, detent mechanisms 550 are arranged in an obtuse angular position with respect to each other and shaft 540.

Figure 5E:
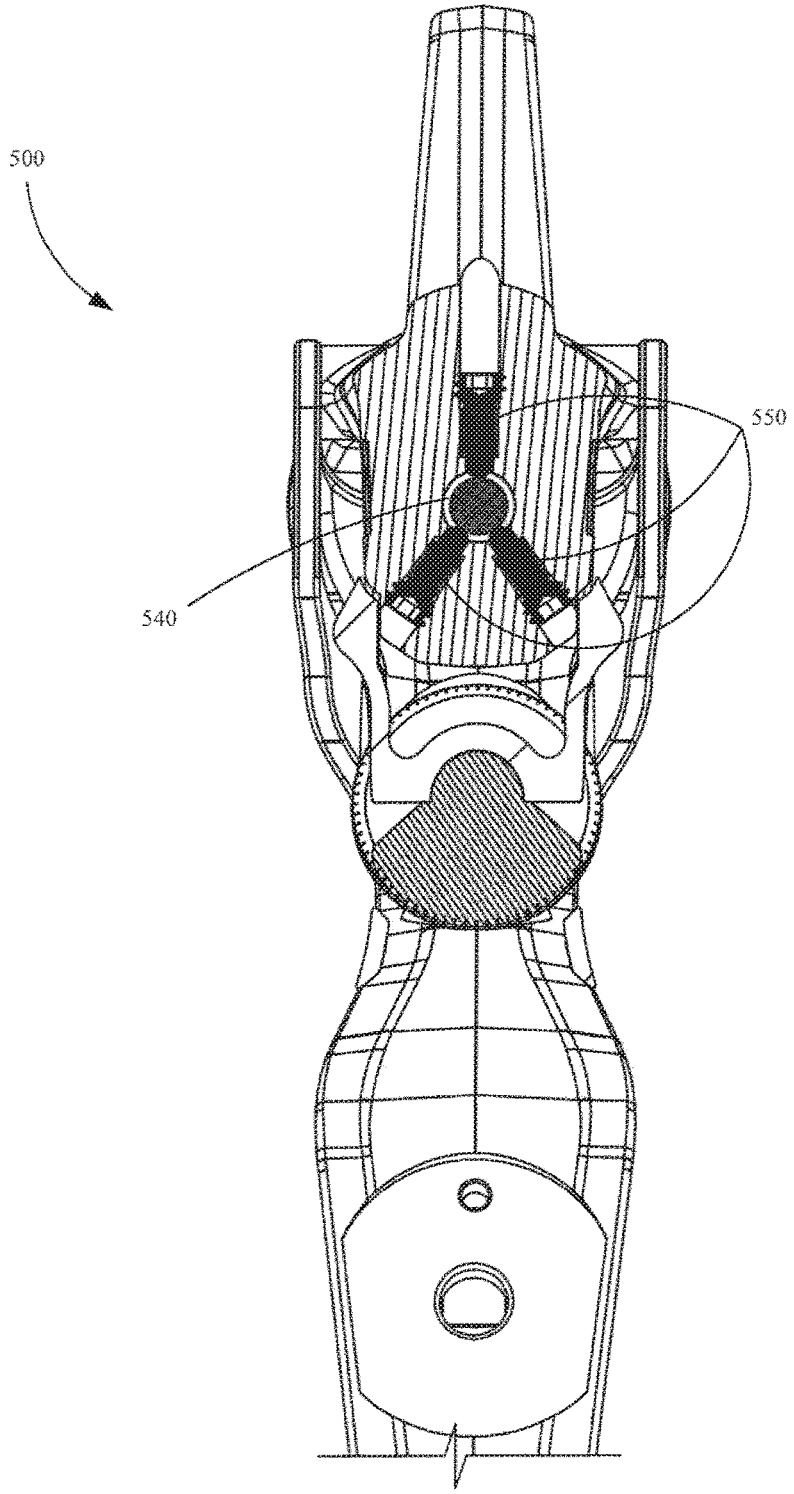

More, or fewer, detent mechanisms 550 may be used, in different embodiments. For example, additional detent mechanisms may serve to relieve additional force required to maintain trigger 510 in an actuated position. For example, FIG. 5E illustrates a configuration of three detent mechanisms 550 arranged about shaft 540. In one embodiment, all three detent mechanisms 550 in FIG. 5E are in the same plane. In another embodiment, detent mechanisms 550 are staggered along the inside of the frame such that all three interact with threads on shaft 540.

Figure 6:
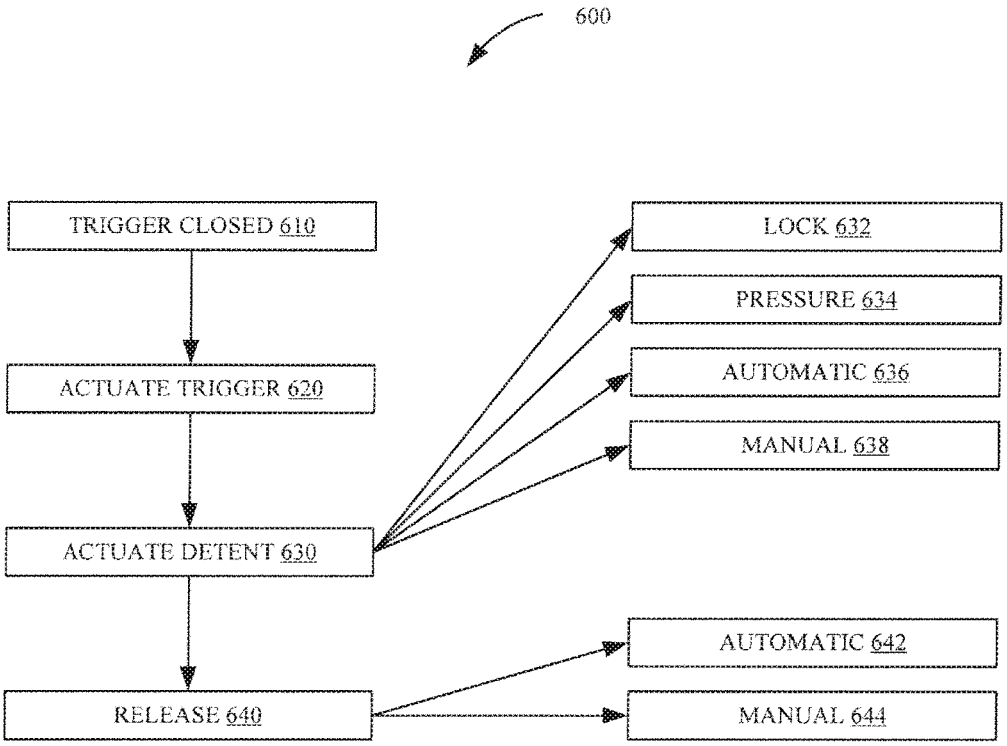
FIG. 6 is a flow diagram of an example method of using a trigger detent mechanism in accordance with one embodiment of the present invention.

FIG. 6 is a flow diagram of an example method of using a trigger detent mechanism in accordance with one embodiment of the present invention. Method 600 may be used, for example, with any of applicators 100, 200, 250, 300, 400 and/or, applicator 500. Additionally, method 600 may be appropriate for applicators with other detent configurations.

In block 610, a trigger is in a closed position. This may comprise, for example, an applicator initially hooked up to a fluid source, but not actively spraying. In another embodiment, the closed position comprises an applicator held by a user with substantially no force applied to a trigger, for example at the end of a spraying operation.

In block 620, a user actuates a trigger. In one embodiment, actuating a trigger comprises causing a trigger to rotate about a trigger pivot point. In another embodiment, actuating a trigger comprises the trigger transitioning between closed and open positions, such that fluid flows into an applicator and is dispersed from a dispersal point.

In block 630, a user actuates a detent mechanism. In one embodiment, the detent mechanism is automatically actuated, as indicated in block 636, by a trigger moving into a detent position, for example during normal actuation of the trigger. In one embodiment, a trigger may move into a detent position by being rotated beyond a detent point, such that detent mechanism features couple to a detent support, for example either located at a detent coupling point or elsewhere on or inside an applicator.

In another embodiment, actuating a detent mechanism comprises manual actuation, as indicated in block 638. Manual activation may comprise pressing a button, or activating a locking mechanism, such that a detent mechanism is not automatically engaged without some user actuation. In one embodiment, actuating a detent mechanism comprises locking a trigger into place, for example as indicated in block 632. This may be advantageous for a user who intends to retain a trigger in an actuated position for a significant period of time, and may want to retain an actuated trigger without significant fatigue symptoms.

In another embodiment, actuating a detent mechanism comprises some, but not complete, pressure relief as indicated in block 634. This may be advantageous such that if a user urgently needs to cease fluid flow from the applicator, the user simply needs to release the trigger, and the detent mechanism will release simultaneously, or substantially simultaneously in one embodiment.

In block 640, the detent mechanism is released. In one embodiment, the detent mechanism is released automatically, as indicated in block 642, by a user ceasing applied pressure to a trigger of the applicator. In one embodiment, releasing a trigger causes automatic and simultaneous release of a trigger detent mechanism. In another embodiment, releasing the trigger detent mechanism requires at least some manual interaction by a user, as indicated in block 644, for example, releasing a switch or actuating a button maintaining the detent mechanism.

Figure 7:
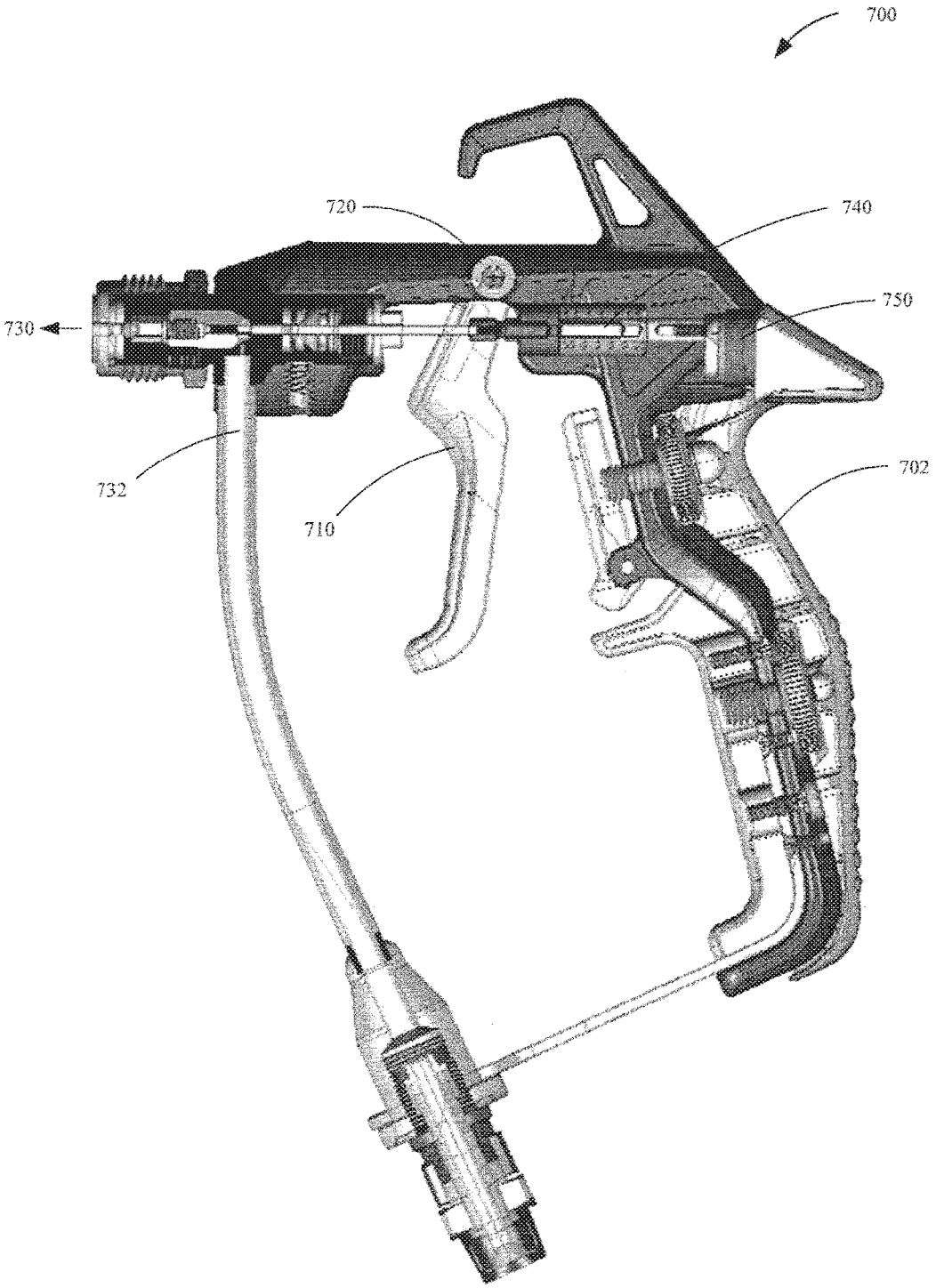
FIG. 7 illustrates a magnetic trigger detent mechanism in accordance with one embodiment of the present invention.

FIG. 7 illustrates a magnetic trigger detent mechanism in accordance with one embodiment of the present invention. Applicator 700 comprises a handle 702 and an outlet 730, configured to release a spray of fluid received from a fluid flow path 732, when a trigger 710 is actuated.

Trigger 710, in one embodiment, is configured to rotate about a pivot point 720, when actuated. In one embodiment, actuation of trigger 710 causes a shaft 740 to move within applicator 700, toward a magnet 750. As shaft 740 approaches magnet 750, in one embodiment, magnet 750 exerts a magnetic force toward shaft 740. The magnetic force may be sufficient, in one embodiment, to relieve some of the force required to actuate hold trigger 710 in an actuated position. However, in at least one embodiment, the magnetic force is insufficient to maintain trigger 710 in a fully-actuated position. This may allow for a user of applicator 700 to cease fluid flow by releasing trigger 710.

In one embodiment, magnet 750 comprises a magnetic material, for example a neodymium magnet, a rare-earth magnet, a ferrite magnet, a samarium cobalt magnet, an aluminum-nickel-cobalt magnet, or another composition. In another embodiment, magnet 750 comprises a temporarily magnetized metal. In a further embodiment, magnet 750 comprises an electromagnet, such as a solenoid, for example. In one embodiment, shaft 740 comprises a metal material configured to react to a magnetic force exerted by magnet 750. In another embodiment, shaft 740 comprises a magnetic material configured to exert a magnetic force on magnet 750. In one embodiment, the magnetic material of shaft 740 and magnet 750 are complementary, such that they mutually attract each other. In one embodiment, the magnetic material of shaft 740 is different from the magnetic material comprising magnet 750.

Figure 8A:
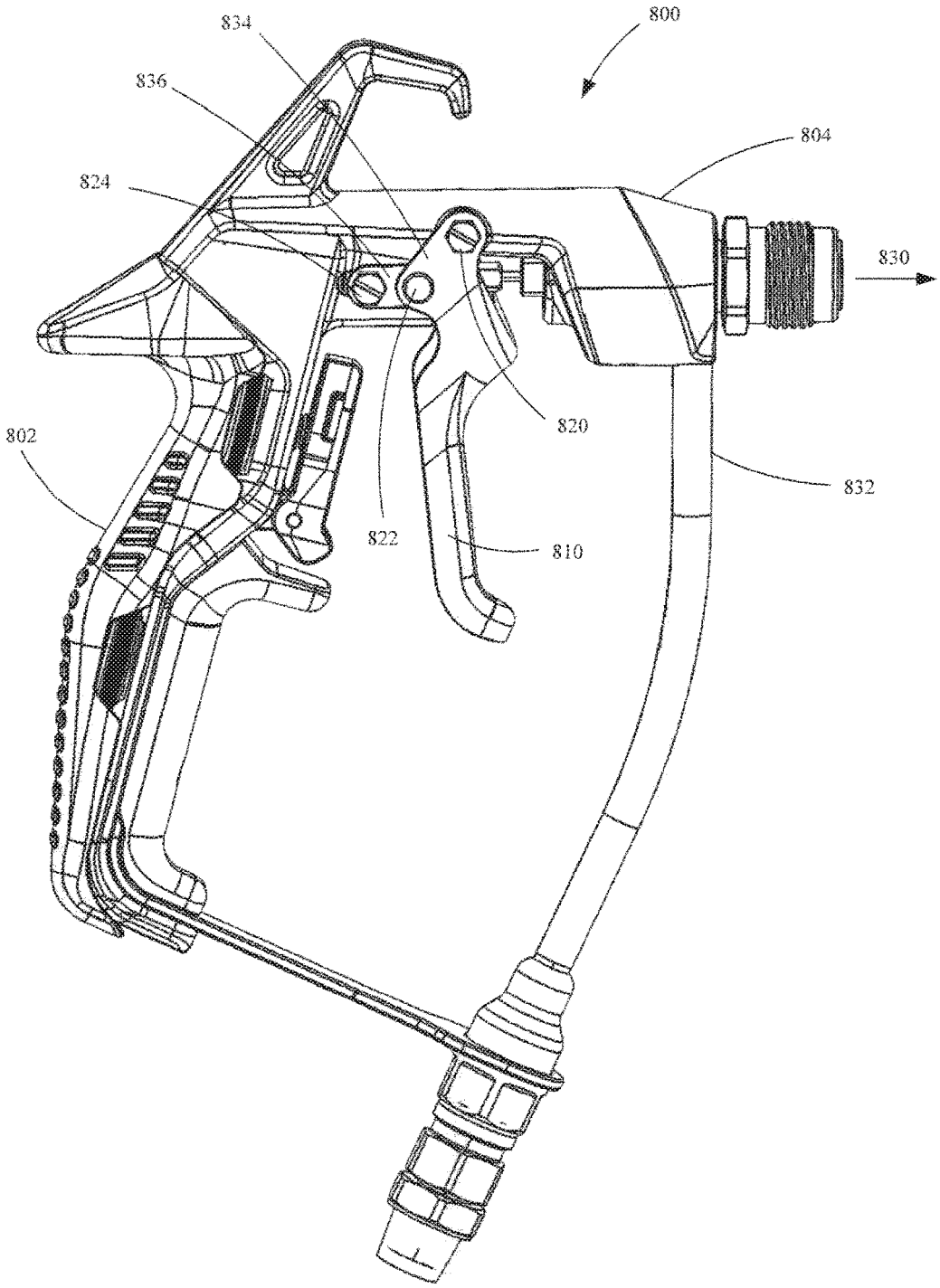
FIGS. 8A and 8B illustrate a mechanical trigger detent mechanism in accordance with one embodiment of the present invention.
Figure 8B:
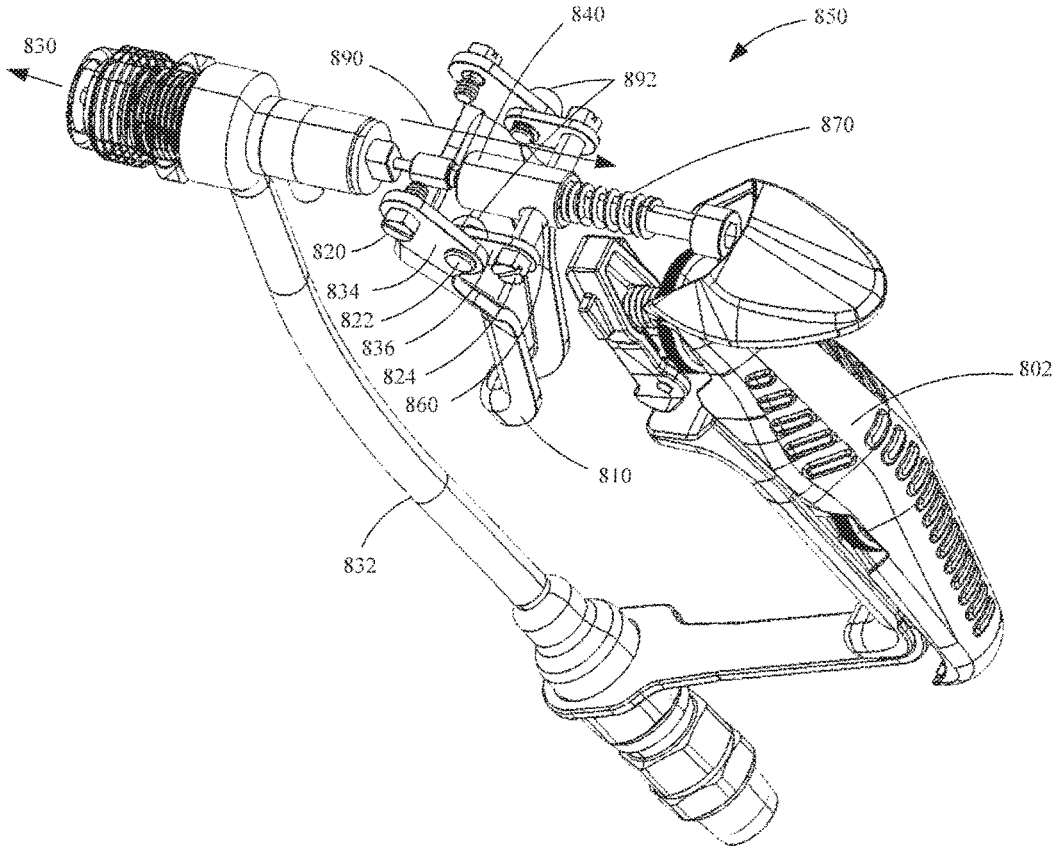

FIGS. 8A and 8B illustrate a mechanical trigger detent mechanism in accordance with one embodiment of the present invention. FIG. 8A illustrates an applicator 800, used to apply a fluid to a surface, for example. Applicator 800 comprises a handle 802 coupled to a frame 804, and an outlet

830, configured to release a spray of fluid received from a fluid flow path 832, when a trigger 810 is actuated.

Trigger 810, in one embodiment, is configured to rotate about a first pivot point 820 when actuated. In one embodiment, first pivot point 820 is coupled to an internal pivot point 822 by a connection 834. In at least one embodiment, connection 834 comprises a portion of trigger 810. In one embodiment, connection 834 is configured to rotate about both first pivot point 820, and internal pivot point 822, as trigger 810 is actuated. Rotation of connection 834 about internal pivot point 822, in one embodiment, causes lateral movement of connection 836, and second pivot point 824 in a direction away from outlet 830.

FIG. 8B illustrates a view of a mechanical trigger detent mechanism 850, with frame 804 removed for the sake of clarity, but not by limitation. In one embodiment, trigger detent mechanism 850 comprises linkages that operate similar to a toggle clamp. In one embodiment, connection 834 and 836 are configured to pivot, as trigger 810 is actuated, such that an angle 892 changes. Actuation of trigger 810, in one embodiment, causes shaft 840 to move in the direction indicated by arrow 890, compressing a compression element 870. In one embodiment, shaft 840 moves in the direction indicated by 890, angle 892 becomes more obtuse. Angle 892, in one embodiment, is greater than 90° when trigger 810 is in a non-actuated, resting position. Angle 892, in one embodiment, is less than 180° when trigger 810 is fully actuated.

In one embodiment, as angle 892 becomes more obtuse, a force required to maintain trigger 810 in a partially-actuated position decreases. In one embodiment, substantially no force is required to maintain trigger 810 in a fully-actuated position. In another embodiment, a force is required to maintain trigger 810 in a fully-actuated position, representing a fraction of the force required to initially actuate trigger 810.

In one embodiment, as shaft 840 moves in the direction indicated by arrow 890, a shaft bar is configured to engage compression element 870. As shown in FIG. 8B, in one embodiment the compression element 870 is a spring. In another embodiment, compression element 870 is any suitable compressible unit that provides a force sufficient to cause an actuated trigger 810 to return to a non-actuated position when a force is released (e.g. when a user lets go of trigger 810).

Although the present invention has been described with reference to preferred embodiments, workers skilled in the art will recognize that changes may be made in form and detail without departing from the spirit and scope of the invention.

What is claimed is:

1. A fluid applicator comprising:

an inlet and an outlet fluidically coupled by a fluid path;

a trigger configured to, when actuated, move between a closed position and an open position, wherein the open position allows a fluid flow from the inlet, to the outlet, along the fluid path; and a trigger support configured to reduce a pressure required to maintain the trigger in the open position, wherein the trigger support is configured to reduce the pressure required as the trigger actuates between the closed position and the open position.

2. The fluid applicator of claim 1, wherein reducing a pressure comprises a partial reduction, such that at least some pressure is required to maintain the trigger in an open position.

3. The fluid applicator of claim 1, wherein reducing a pressure comprises a substantially complete reduction, such that substantially no pressure is required to maintain the trigger in an open position.

4. The fluid applicator of claim 1, wherein the trigger is configured to return to the closed position when an applied pressure is removed.

5. The fluid applicator of claim 1, wherein the trigger support comprises a first connection bar coupled to a frame of the applicator at a first pivot point, and a second connection bar at an internal pivot point, wherein an angle at the internal pivot point is configured to increase as the trigger is actuated.

6. The fluid applicator of claim 5, wherein the second connection bar is configured to move laterally, and the first connection bar is configured to move rotationally.

7. The fluid applicator of claim 5, wherein the angle is an obtuse angle when the trigger is in a resting position.

8. A fluid applicator comprising:

a trigger that is configured to be actuated from a closed position to an open position by applying pressure to the trigger, wherein, when the trigger is in the open position, a fluid, received from a fluid source, flows along a flow path through the applicator and is dispersed from an outlet;

a support mechanism, configured to, when actuated, change a pressure, required to maintain the trigger in the open position, from a first pressure to a second pressure that comprises a portion of the first pressure; and wherein release of the trigger ceases flow of the fluid along the fluid path.

9. The fluid applicator of claim 8, wherein actuation of the trigger comprises rotation of the trigger about a trigger pivot point.

10. The fluid applicator of claim 8, wherein actuation of the support mechanism occurs substantially simultaneously with actuation of the trigger.

11. The fluid applicator of claim 8, wherein the release comprises releasing the applied second pressure.

12. The fluid applicator of claim 8, wherein the support mechanism comprises an internal pivot point of a coupling between a shaft of the applicator and the trigger, wherein the internal pivot point comprises an angle, wherein the angle is an obtuse angle while the trigger is in a resting position.

13. The fluid applicator of claim 12, wherein actuating the support mechanism comprises increasing the angle as the trigger moves between the resting position and the actuated position.

14. The fluid applicator of claim 8, wherein releasing comprises actuating a compression element configured to cause the trigger to return to a resting position.

15. A tension relief system for a trigger of a fluid applicator, the system comprising:

a trigger portion coupled to the trigger and an internal pivot point;

an applicator portion coupled to a shaft of the applicator and the internal pivot point, such that the trigger portion and the applicator portion form an obtuse angle; and wherein, as the trigger is actuated, the trigger portion and applicator portion actuate such that a pressure required to actuate the trigger reduces as the trigger moves from a resting position to an actuated position such that a pressure required to maintain the trigger in the actuated position is less than that required to initially move the trigger from the resting position.

16. The system of claim 15, wherein the obtuse angle increases as the trigger moves from the resting position to the actuated position.

17. The system of claim 15, wherein the trigger portion is configured to move laterally as the trigger is actuated.

18. The system of claim 15, wherein the applicator portion is configured to move rotationally as the trigger is actuated.

19. The system of claim 15, wherein the trigger is configured to return from the actuated position to the resting position when the pressure required to maintain the trigger in the actuated position is released.

20. The system of claim 19, wherein the trigger is urged from the actuated position to the resting position by a compression element.

* * * * *